US005711420A

United States Patent [19]

Spring

[11] Patent Number: 5,711,420

[45] Date of Patent: Jan. 27, 1998

[54] APPARATUS FOR DISPENSING A SUBSTANCE IN A LIQUID BEVERAGE

[75] Inventor: Robert E. Spring, New York, N.Y.

[73] Assignee: Canning Concepts, Inc., Locust Valley, N.Y.

[21] Appl. No.: 603,979

[22] Filed: Feb. 20, 1996

[51] Int. Cl.[6] ..... B65D 25/08

[52] U.S. Cl. ..... 206/222; 206/219; 220/269; 220/528

[58] Field of Search ..... 206/219, 222, 206/568, 217; 220/277, 528, 501, 505, 269, 906

[56] References Cited

U.S. PATENT DOCUMENTS

| | | | |
|---|---|---|---|
| 2,417,592 | 3/1947 | Dwyer . | |
| 2,752,036 | 6/1956 | Parkhurst . | |
| 3,134,577 | 5/1964 | Bollmeier . | |
| 3,779,372 | 12/1973 | De Lloret | 206/222 |
| 4,221,291 | 9/1980 | Hunt . | |
| 4,264,007 | 4/1981 | Hunt . | |
| 4,333,581 | 6/1982 | Flansburg . | |
| 4,995,218 | 2/1991 | Byrne . | |
| 5,054,642 | 10/1991 | Yoshida | 220/269 |
| 5,255,812 | 10/1993 | Hsu . | |
| 5,290,574 | 3/1994 | Jamieson et al. | 206/222 |

*Primary Examiner*—Paul T. Sewell
*Assistant Examiner*—Nhan T. Lam
*Attorney, Agent, or Firm*—Robert D. Katz; Robert T. Maldonado

[57] ABSTRACT

An apparatus for dispensing a substance in a liquid beverage contained in a container includes a receptacle containing the substance formed in the interior of the container and a tab attached to the top of the container for bursting the receptacle to dispense the substance and for opening a pour panel in the top of the container so that the liquid beverage container be drunk from the container. The receptacle can be formed in the top of the container such that it is upwardly openable so that a dispenser containing the substance to be dispensed can be added to the receptacle after the container has been manufactured.

6 Claims, 2 Drawing Sheets

APPARATUS FOR DISPENSING A SUBSTANCE IN A LIQUID BEVERAGE

FIELD OF THE INVENTION

The present invention relates generally to beverage containers and, more specifically, to devices that dispense a substance, including a medication, into a beverage in a container.

BACKGROUND OF THE INVENTION

Various devices for dispensing a substance into a beverage container have been proposed. Some of these devices include a a separate chamber formed at the top of the beverage container to hold the substance to be dispensed, but do not include an integral mechanism for rupturing the chamber and for opening the container. See, for example, U.S. Pat. No. 3,305,368 (Bourelle). Such devices are not arranged so that a user can choose to either rupture the chamber to dispense the substance or leave the chamber intact so that the beverage can be consumed without the substance. Many other dispensing devices require a specially designed top that must be removably attached to the open top of a container. The substance is then dispensed and the top is removed so that the beverage can be consumed. In these devices, the substance chamber is not part of a permanently attached top. For example, see U.S. Pat. Nos. 3,326,363 (Bennett), 3,779,372 (de Lloret), 4,634,003 (Ueda), and 5,052,553 (DeSanctis).

Still other closures include a top with a plurality of substance chambers, that is snapped onto the beverage container. Depressing a portion of the top releases the substance contained in the top into the container, then the lid is removed to pour the beverage. The beverage is not consumed directly from the container. See, for example, U.S. Pat. No. 4,785,931 (Weir). None of these devices includes a chamber in the top of the container that is compatible with a separately manufactured substance dispenser.

SUMMARY OF THE INVENTION

It is therefore an important or principal object of the present invention to provide an apparatus that facilitates the dispensing of a substance in a liquid beverage contained in a beverage container, such as a soft drink can, and which is compatible with existing canning techniques.

The foregoing objects are achieved, and the disadvantages of other devices overcome by providing an apparatus for dispensing a substance in a liquid beverage that includes a cylindrical container with a non-resealable pour panel and a tab attached to a retain tab top end and a receptacle attached to an underside of a top of the container, wherein the receptacle contains the substance to be dispensed and includes an unbreakable side, an unbreakable top, and a thin, breakable bottom. The receptacle is angularly displaced from the pour panel and is burst open by lifting the tab. To aid in opening, an optional pin may be provided on an underside of the top of the receptacle, and an indicator on an exterior of the container may note when the receptacle has been ruptured.

In another aspect of the present invention, the receptacle opens upwardly to receive a substance dispenser containing a substance to be dispensed.

BRIEF DESCRIPTION OF THE DRAWINGS

Further objects, features and advantages of the invention will become apparent upon review of the following detailed description of the preferred embodiments, taken in conjunction with the following drawings, in which.

DETAILED DESCRIPTION OF PREFERRED EMBODIMENTS

The different embodiments of the present invention relate to the configuration and operation of a receptacle that contains a substance to be dispensed in a liquid beverage. The substance can be medication, such as analgesics or prescription medicines, a flavoring agent, a sweetening agent such as aspartame, or an alcoholic beverage, for example. The separate receptacles can be manufactured and sold or stored separately from the cans, for example, at a pharmacy or hospital. It will be particularly useful for dispensing medicines to those who have difficulty swallowing pills.

Figure 1:
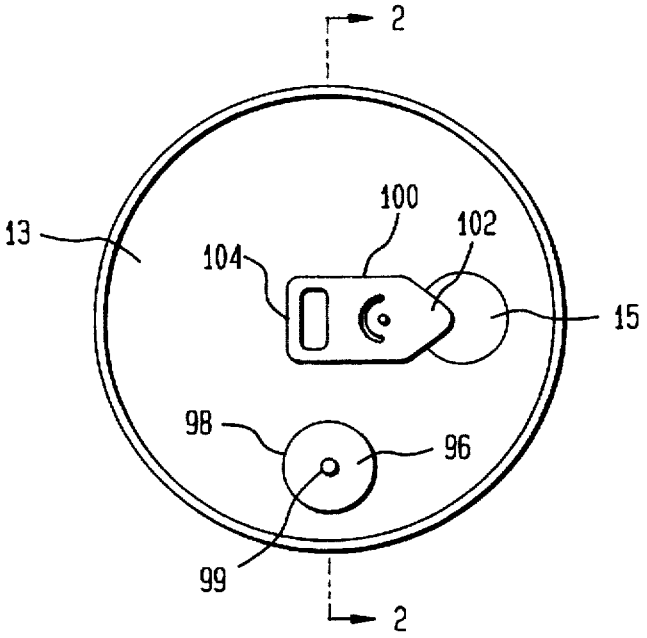
FIG. 1 is a top view of a beverage container incorporating the ingredient dispenser of the present invention.
Figure 2:
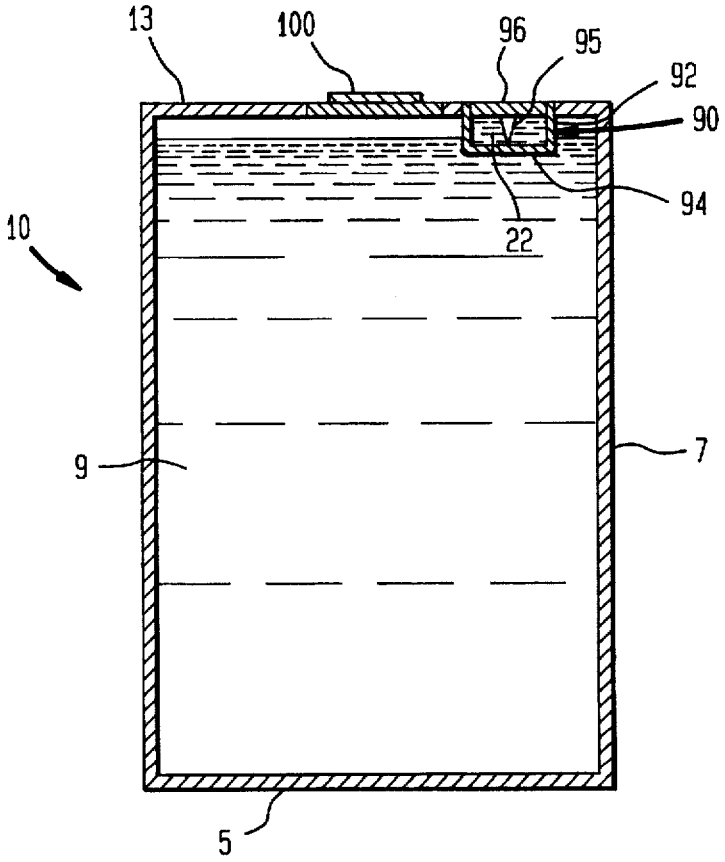
FIG. 2 is a sectional view of a beverage container of FIG. 1 taken along line 2—2 of FIG. 1 including an ingredient dispenser according to the present invention.

Referring to the drawings, FIGS. 1–5 present various views of several embodiments of an ingredient dispenser in accordance with the present invention for use in conjunction or combination with a conventional beverage container such as a soft drink can, as shown in FIGS. 1 and 2. The beverage container 10 is formed of a retain tab top 13, a bottom 5, which may be an integral part of the top 13 or attached separately, and a body or sidewall 7. The container 10 is cylindrical in shape and contains a beverage 9 to be consumed by a user. The beverage 9 could be a carbonated or non-carbonated soft drink, fruit juice, mixer, sport drink, water, or other appropriate or applicable liquid, for example. The top 13 of the container 10 has a pour panel 15 that is openable and non-resealable. The pour panel 15 is opened with an opener tab 100 attached to the upper side of the top 13 of the container 10.

According to a first embodiment of the present invention shown in FIGS. 1 and 2, a dispensing apparatus includes a receptacle 90 (preferably in the shape of a flat right cylinder) attached to an underside of the top 13 of the container 10. The receptacle 90 includes unbreakable sidewalls 92 and a breakable bottom 94 and is formed or affixed during the manufacture of the can top 13. The top 96 of the receptacle 90 is deformable, unbreakable material that covers a hole 98 formed in the top 13 of the container 10. The top 96 may also include an optional pin 95 or other piercing object projecting downward from an underside of the top 96 into the receptacle 90 to facilitate puncturing the bottom 94, which is also scored or otherwise manufactured to burst downward upon application of pressure upon the top 96 of the receptacle 90. The space defined by the bottom 94, the sidewalls 92 and the top 96 of the receptacle 90 contains a solid or liquid substance 22 to be dispensed in the liquid beverage 9 contained in the container 10.

An opener tab 100 having an elongated breaking end 102 opposite a lifting end 104 is attached to the top 13 of the container 10 for dispensing the substance 22 and for opening the pour panel 15 of the container 10. The opener tab 100 is rotatable about point B in FIG. 1.

Referring still to FIGS. 1 and 2, the operation of this embodiment can be understood. Prior to opening the pour panel 15 of the top 13 of the container 10, the user rotates the opener tab 100 about the point B (clockwise in FIG. 1) so that the breaking end 102 is aligned with the top 96 of the receptacle 90. The user then lifts the lifting end 104 of the opener tab 100 causing the breaking end 102 to move downward, thereby depressing the top 96 of the receptacle 90. Upon such depression, the substance 22 in the receptacle 90 is compressed, causing the bottom 94 of the receptacle 90 to break open, releasing the substance 22 into the liquid beverage 9 contained in the container 10. Alternatively, the depression of the top 96 causes the pin 95 to move downward, thereby puncturing the bottom 94 of the receptacle 90 and releasing the substance 22 in the liquid beverage 9. The depression of the top 96 of the receptacle 90 activates an indicator 99 formed in the top 96 of the receptacle 90 to indicate that the substance 22 has been dispensed.

The user then rotates the opener tab 100 in the opposite direction about point B (counterclockwise in FIG. 1) so that the breaking end 102 is aligned with the pour panel 15 formed in the top 13 of the container 10. The user then lifts the lifting end 104 of the opener tab 100 causing the breaking end 102 to move downward, thereby breaking open the pour panel 15 of the top 13 of the container 10. Once the pour panel 15 has been broken open, the beverage 9 that has been mixed with the substance 22 can be drunk or poured.

Figure 3:
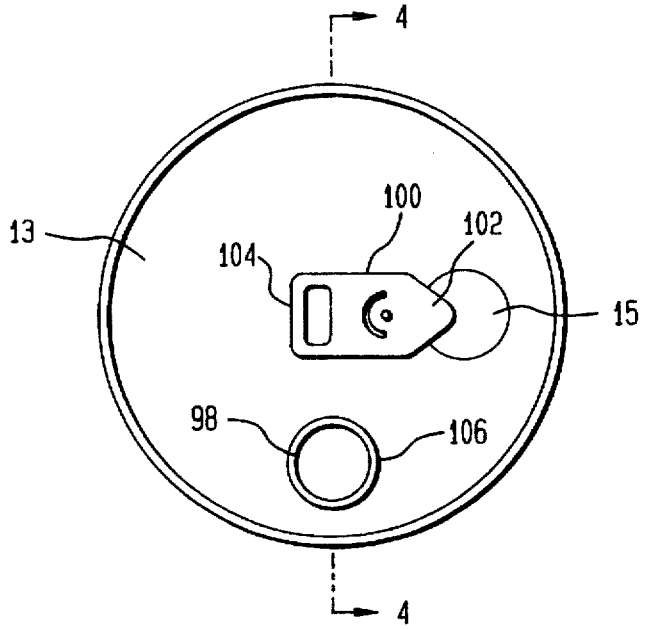
FIG. 3 is a top view of a beverage container according to a second embodiment of the present invention.
Figure 4:
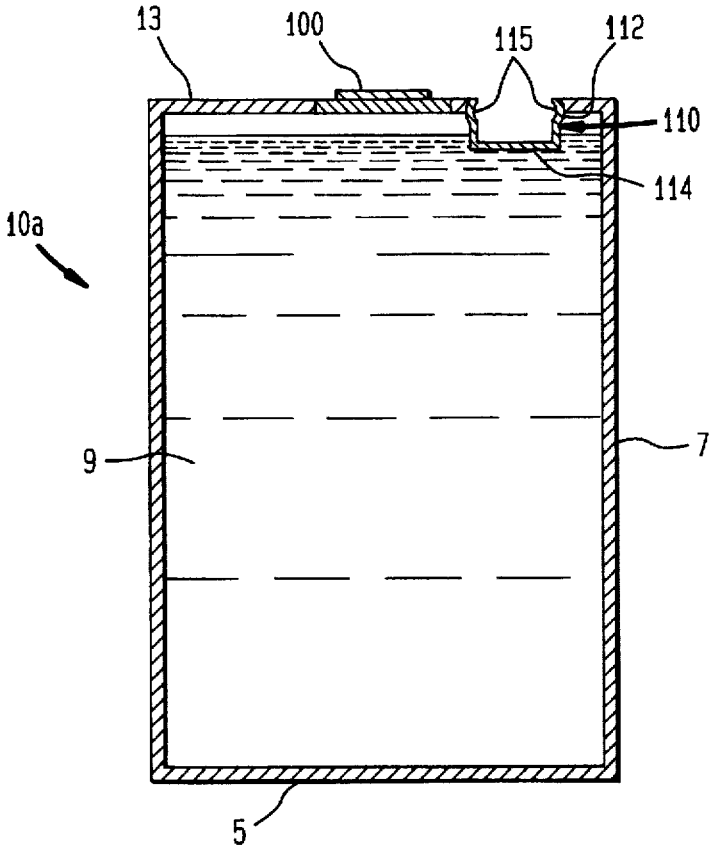
FIG. 4 is a sectional view taken along line 4—4 of FIG. 3 of a beverage container including a receptacle according to the second embodiment of the present invention.
Figure 5:
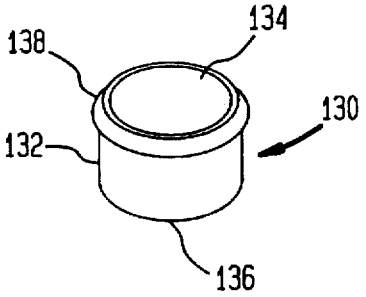
FIG. 5 is a perspective view of a substance dispenser for use in the second embodiment of the present invention.

Another embodiment of the present invention illustrated in FIGS. 3 and 4 includes a container 10*a* with a well 110 attached to an underside of the top 13 of the container 10. The well 110 of the present embodiment is preferably shaped similarly to the receptacle 90 in the previous embodiment, including unbreakable sidewalls 112 and a breakable bottom 114 manufactured in a manner so that upon the breaking of a seal in the bottom of the well 110 the substance to be dispensed is released downward, as described hereinafter. The sidewalls 112 of the well 110 may include a circumferential slot 115.

The well 110 may or may not include a top. If it does include a top, as shown in FIG. 3, the top 106 should peel back easily to protect the cleanliness of the well 110 during storage. Otherwise, the embodiment does not differ significantly from the one depicted in FIGS. 1 and 2, and is upwardly open at the hole 98 formed in the top 13 of the container 10. The shape of the well 110 can be cylindrical to accommodate a cylindrical substance dispenser 130, shown in FIG. 5. The substance dispenser 130 includes an unbreakable, deformable top 134, an unbreakable sidewall 132, and a scored burstable bottom 136. The outer diameter of the substance dispenser 130 is substantially equal to the inner diameter of the well 110 so that when the dispenser 130 is inserted in the well 110, it fits tightly and will not become dislodged. Alternatively, the sidewall 132 of the dispenser 130 may include a circumferentially projecting lock rim 138 that fits in the slot 115 formed in the sidewall 112 of the well 110. This feature ensures that the dispenser 130 will securely lock into the well 110 upon insertion therein and will not become dislodged. These embodiments makes it possible to add medicine to the receptacle after the container 10 has been manufactured and, thus, enables the container 10*a* to be sold separately from the dispenser 130, including in drugstores.

Operation of the dispensing apparatus according to this embodiment is quite similar to the operation of the first embodiment, except that first, the user must insert the dispenser 130 through the hole 98 formed in the top 13 of the container 10*a* and into the well 110, with the breakable bottom 136 of the dispenser 130 abutting the breakable bottom 114 of the well 110. The user then rotates the opener tab 100 about the point B (clockwise in FIG. 3) so that the breaking end 102 is aligned with the top 134 of the dispenser 130. The user then lifts the lifting end 104 of the opener tab 100 causing the breaking end 102 to move downward, thereby depressing the top 134 of the dispenser 130. Upon such depression, the substance in the dispenser 130 is compressed, causing the bottom 136 of the dispenser 130 and, simultaneously, the bottom 114 of the well 110 to break open and the substance is released in the liquid beverage 9 contained in the container 10.

The user then rotates the opener tab 100 in the opposite direction about point B so that the breaking end 102 is aligned with the pour panel 15 formed in the top 13 of the container 10. The user then lifts the lifting end 104 of the opener tab 100 causing the breaking end 102 to move downward, thereby breaking open the pour panel 15 of the top 13 of the container 10. Once the pour panel 15 has been broken open, the beverage 9 that has been mixed with the substance 22 can be drunk.

In all embodiments, it may not be necessary to rotate the opening tab to effect release of the substance in the receptacle, but rather simply to use manual pressure. Although the various embodiments of the subject invention have been disclosed and illustrated with reference to application of the dispensing apparatus to an aluminum beverage can, it should be apparent to a person of ordinary skill in the art that the dispensing apparatuses herein disclosed can be modified and adapted without departing from the scope of the present invention. They can be, for example, applied to other types of containers, such as bottles. Having described specific preferred embodiments of the present invention with reference to the accompanying drawings, it is to be understood that the invention is not limited to those precise embodiments, and that various changes and modifications may be effected therein by one skilled in the art without departing from the spirit or the scope of the present invention as defined in the appended claims.

What is claimed is:

1. An apparatus for dispensing a substance in a liquid beverage comprising:

a container for containing a liquid beverage, the container including a body and a top defining an interior;

a well formed in the top comprising a breakable lower portion and an unbreakable side wall and having an open top; and a dispenser containing a substance to be dispensed including an unbreakable top, an unbreakable side, and a breakable lower portion, the dispenser sized to fit in the well, wherein the dispenser is fitted in and held by the well with the lower portion facing downward, so that when pressure is applied to the top of the dispenser, the lower portion of the dispenser and the lower portion of the well break open, thereby dispensing the substance in the beverage.

2. An apparatus according to claim 1, further comprising a tab attached to a top of the container wherein the tab applies the pressure to the top of the dispenser.

3. An apparatus according to claim 1, wherein the well is adjacent an opening in the top for dispensing the beverage.

4. An apparatus according to claim 1, wherein the well is located within an opening in the top for dispensing the beverage.

5. An apparatus according to claim 1, wherein the container is cylindrical.

6. An apparatus according to claim 1, further comprising:

a slot formed in the side wall of the well; and a lock rim protruding from the side of the dispenser, the lock rim fitting in the slot when the dispenser is inserted in the well.

* * * * *